US006402665B1

(12) United States Patent
Edward

(10) Patent No.: US 6,402,665 B1
(45) Date of Patent: Jun. 11, 2002

(54) COMPACT REHABILITATION AND GYM APPARATUS FOR BODY MOTION

(76) Inventor: Poling Edward, 2283 Fulton St., Toledo, OH (US) 43620

( * ) Notice: Subject to any disclaimer, the term of this patent is extended or adjusted under 35 U.S.C. 154(b) by 0 days.

(21) Appl. No.: 09/805,637

(22) Filed: Mar. 12, 2001

(51) Int. Cl.[7] ..... A63B 21/06
(52) U.S. Cl. ..... 482/93
(58) Field of Search ..... 272/118, 117; 482/93, 904, 32, 126, 129, 130, 71; 297/DIG. 4

(56) References Cited

U.S. PATENT DOCUMENTS 4,747,595 A * 5/1988 Mabry et al. ..... 272/118
5,839,995 A * 11/1998 Chen ..... 482/92

* cited by examiner

*Primary Examiner*—Michael A. Brown
*Assistant Examiner*—Lori Baker Amerson

(57) ABSTRACT

A rehabilitation and gym apparatus includes a frame, a central exercise device formed on a central position of the frame for rehabilitating a patient's head motion, at least a first side exercise device formed on a right side (or left side) of the frame for rehabilitating a patient's foot or leg motion; and at least a second side exercise device formed on a left side (or right side) of the frame for rehabilitating a patient's hand or arm motion for providing a convenient rehabilitation unit.

10 Claims, 6 Drawing Sheets

COMPACT REHABILITATION AND GYM APPARATUS FOR BODY MOTION

BACKGROUND OF THE INVENTION

For rehabilitating a disabled or injured patient, he or she must go to a hospital to seek help from a doctor, a therapist or a nurse for a proper rehabilitation program, causing inconvenience for the patient or possibly delaying his or her rehabilitation planning towards a healthy condition.

The present inventor thus invents a compact rehabilitation and gym apparatus which can be moved or placed at home for a convenient and instant rehabilitation use for a patient.

SUMMARY OF THE INVENTION

The object of the present invention is to provide a rehabilitation and gym apparatus including a frame, a central exercise device formed on a central position of the frame for rehabilitating a patient's head motion, at least a first side exercise device formed on a right side (or left side) of the frame for rehabilitating a patient's foot or leg motion and at least a second side exercise device formed on a left side (or right side) of the frame for rehabilitating a patient's hand or arm motion for providing a convenient rehabilitation unit including grip power rehabilitation. Another object of the present invention is to provide a gym unit for exercise purpose.

DETAILED DESCRIPTION

As shown in FIGS. 1~5, a compact rehabilitation and gym apparatus of the present invention comprises: a frame 1, a central exercise means 2 formed on a central portion of the frame 1 for rehabilitating a patient's head or both hands, a first side exercise means 3 formed on a left (or right) side of the frame for rehabilitating a patient's foot or leg portion, and a second side exercise means 4 formed on a right (or left) side of the frame 1 for rehabilitating a patient's hand or arm.

The present apparatus may also be referred as a work unit or a station. Besides the rehabilitation, the present invention may also serve as a gym unit.

Figure 3:
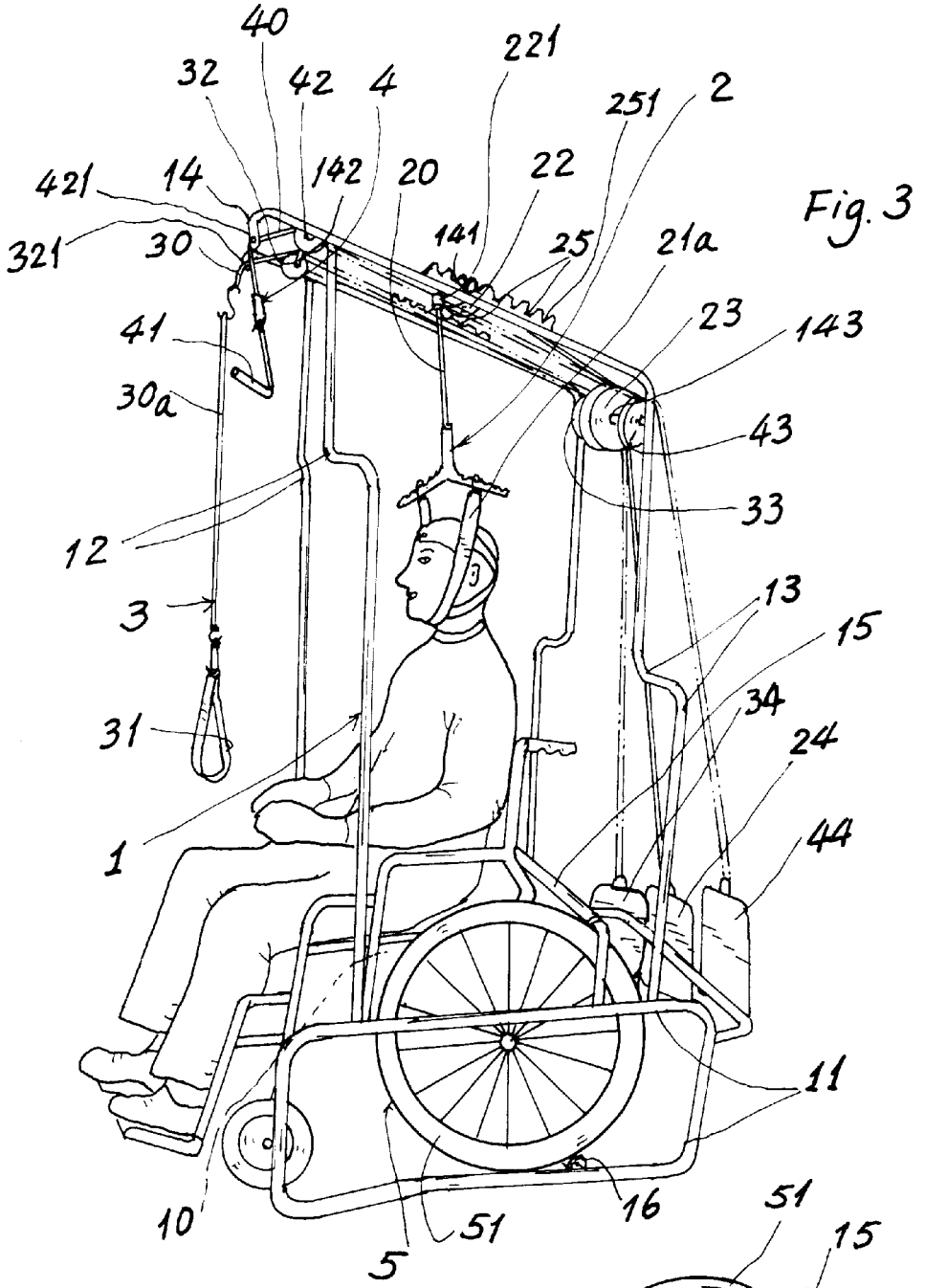
FIG. 3 is an illustration showing the rehabilitation of a patient's head in accordance with the present invention.
Figure 4:
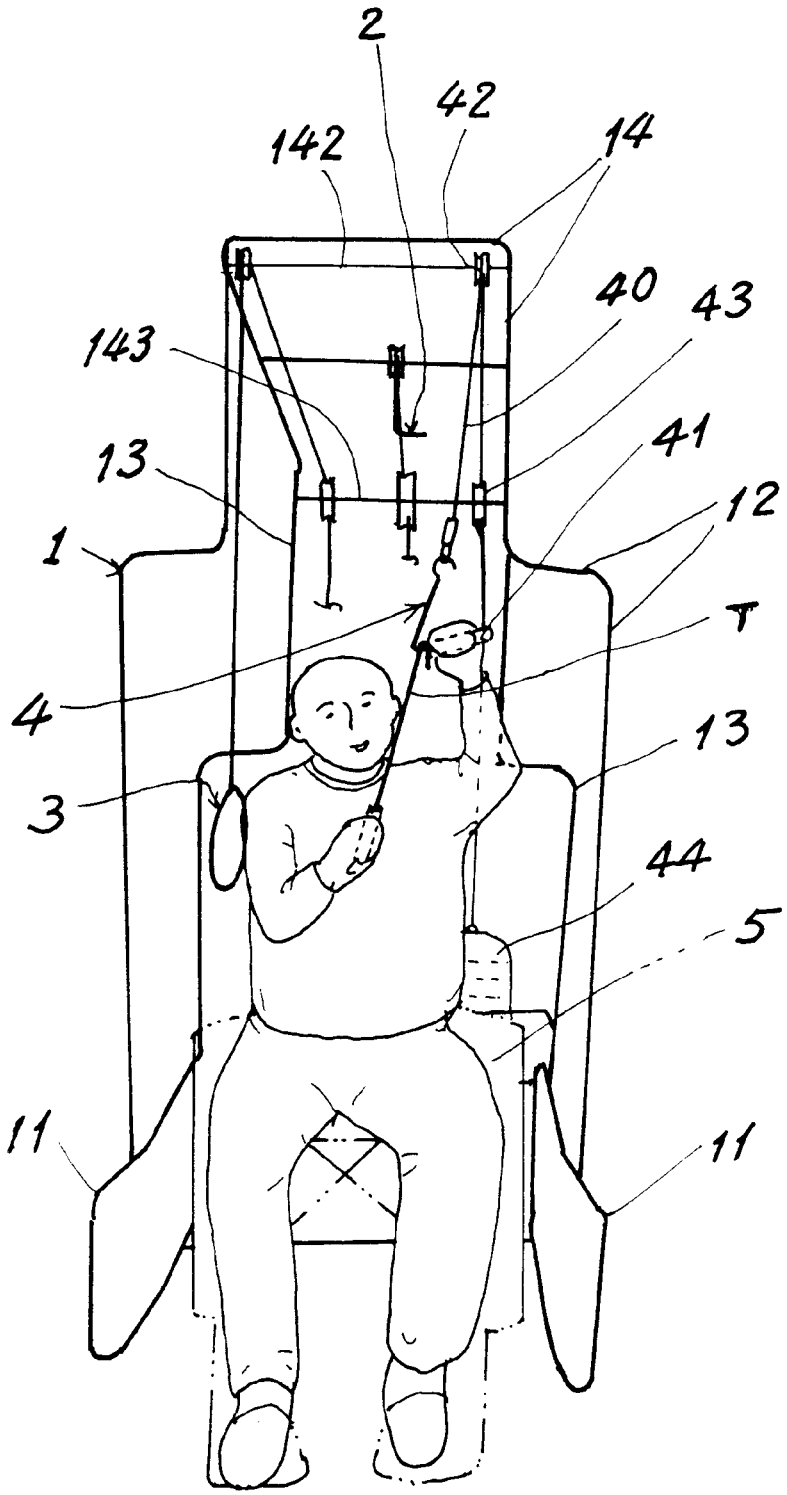
FIG. 4 shows the rehabilitation of a patient's hand by the present invention.
Figure 5:
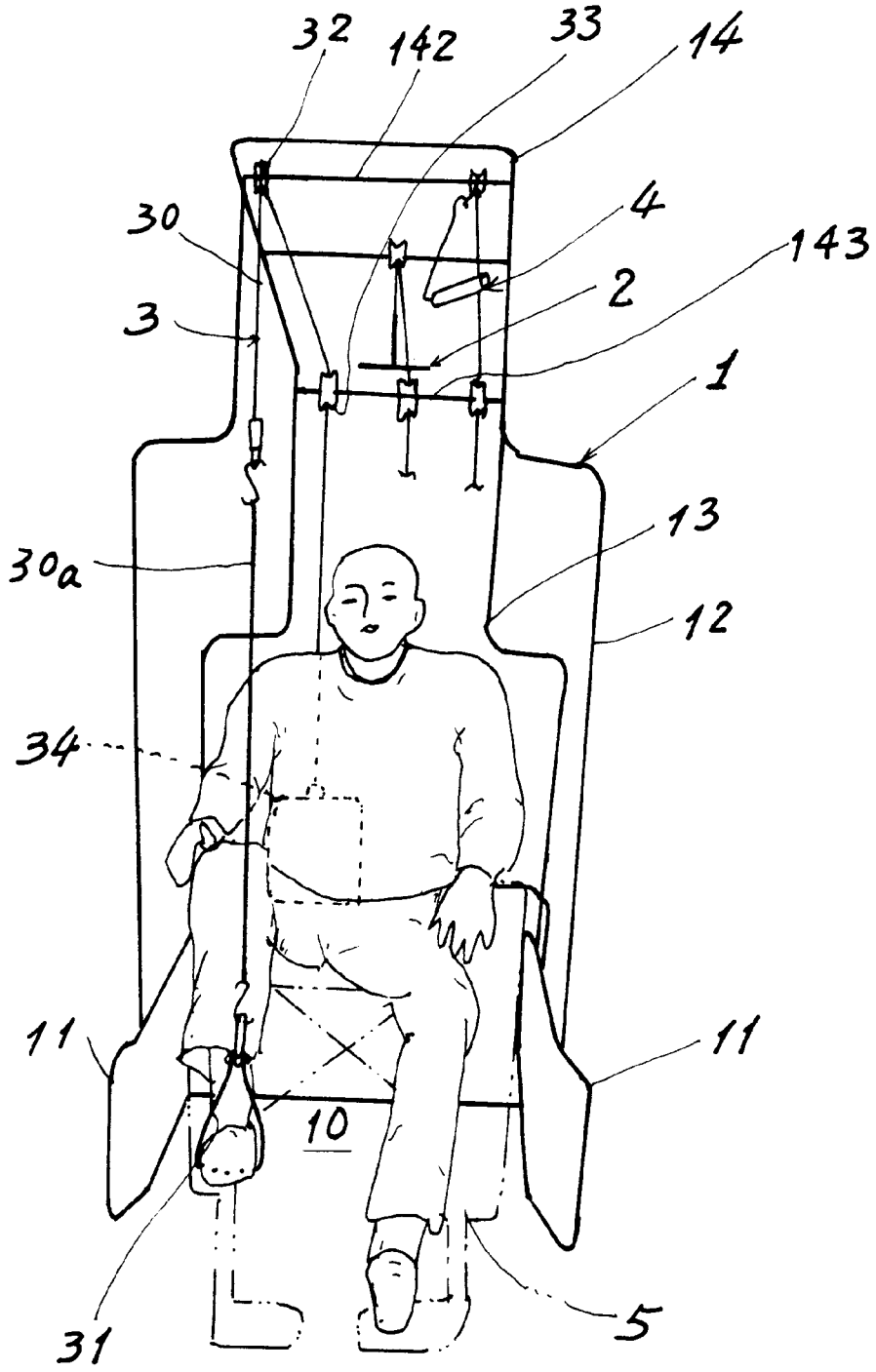
FIG. 5 shows the rehabilitation of a patient's leg and foot by the present invention.

The frame 1 may be accommodated with a wheelchair 5 therein as shown in FIGS. 3~5 for sitting a patient on the wheelchair 5. Naturally, a conventional chair (not a wheelchair) may also be placed within the frame 1 of the present invention.

The frame 1 includes: a base 11 having a void space 10 defined in the base 11 adapted for accommodating a wheelchair 5 in the void space 10 in the base 11, a pair of front columns 12 formed or vertically formed on a front portion of the base 11, a pair of rear columns 13 formed or vertically formed on a rear portion of the base 11, and a roof portion 14 formed on a top portion of the front and rear columns 12, 13 for hanging the central and side exercise means 2, 3, 4 thereon.

Figure 3A:
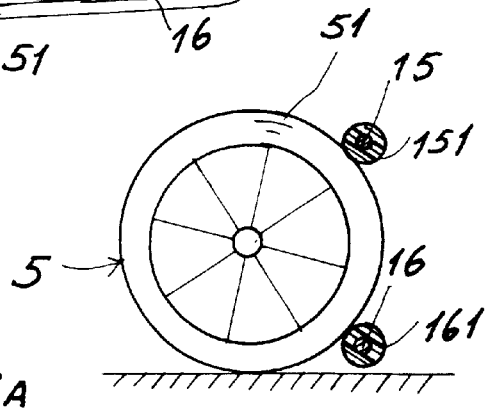
FIG. 3A shows a wheelchair being braked in the present invention.

An upper stopping bar 15 and a lower stopping bar 16 are juxtapositionally formed on a rear portion of the base 11 for frictionally holding a pair of wheels 51 of the wheelchair 5 as shown in FIGS. 3, 3A.

Each stopping bar 15~16 may be jacketed, coated or integrally formed with an elastomer packing sleeve (such as made of rubber or foam materials) thereon for efficiently frictionally holding the wheels 51 of the wheelchair 5.

The central exercise means 2 includes: a central hanger 21 secured to a front end of a central rope 20, a top roller 22 rotatably mounted on a central beam 141 transversely secured on a central portion of the roof portion 14 of the frame 1 for primarily winding the central rope 20 on the top roller 22, an intermediate roller 23 rotatably mounted on a rear beam 143 transversely secured on a rear portion of the roof portion 14 of the frame 1 for secondarily winding the central rope 20 on the intermediate roller 23, and a central counter-weight 24 secured to a rear bottom end of the central rope 20; whereby when alternatively actuating the central hanger 21 downwardly or upwardly as gravitationally balanced by the central counter-weight 24, a patient's head or both hands can be exercised for head or hand motion for rehabilitating his or her head or hands.

Figure 2:
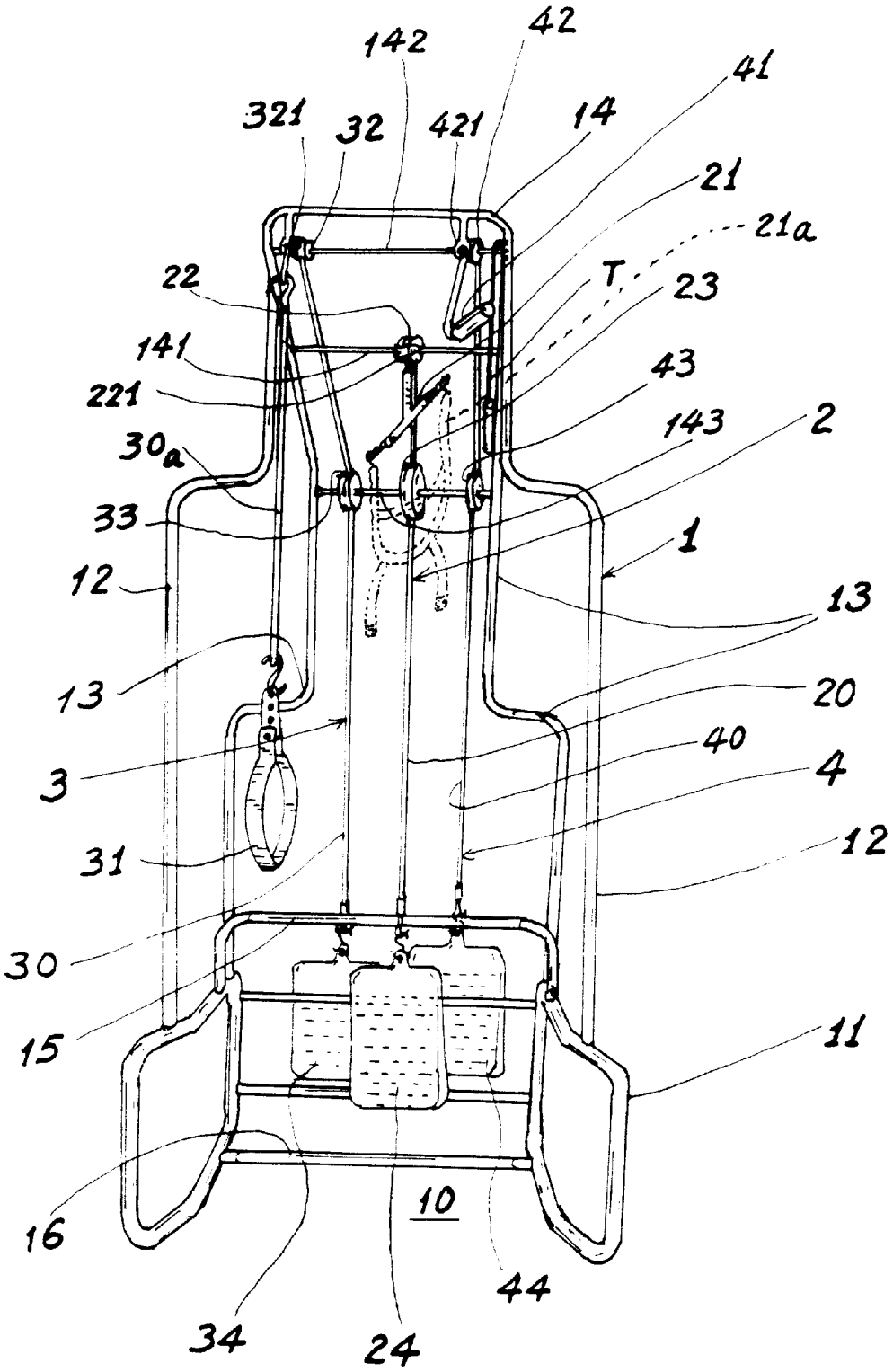
FIG. 2 shows another modification of the present invention.

As shown in FIGS. 2, 3, the central hanger 21 is formed as a head hanger 21*a* for hanging a patient's head in order for rehabilitating his or her head portion. Or, the central (head) hanger 21*a* is provided for firmly holding the patient's head in order to stabilize his or her back bone or spine for a rehabilitation of the back bone or spine.

Figure 1:
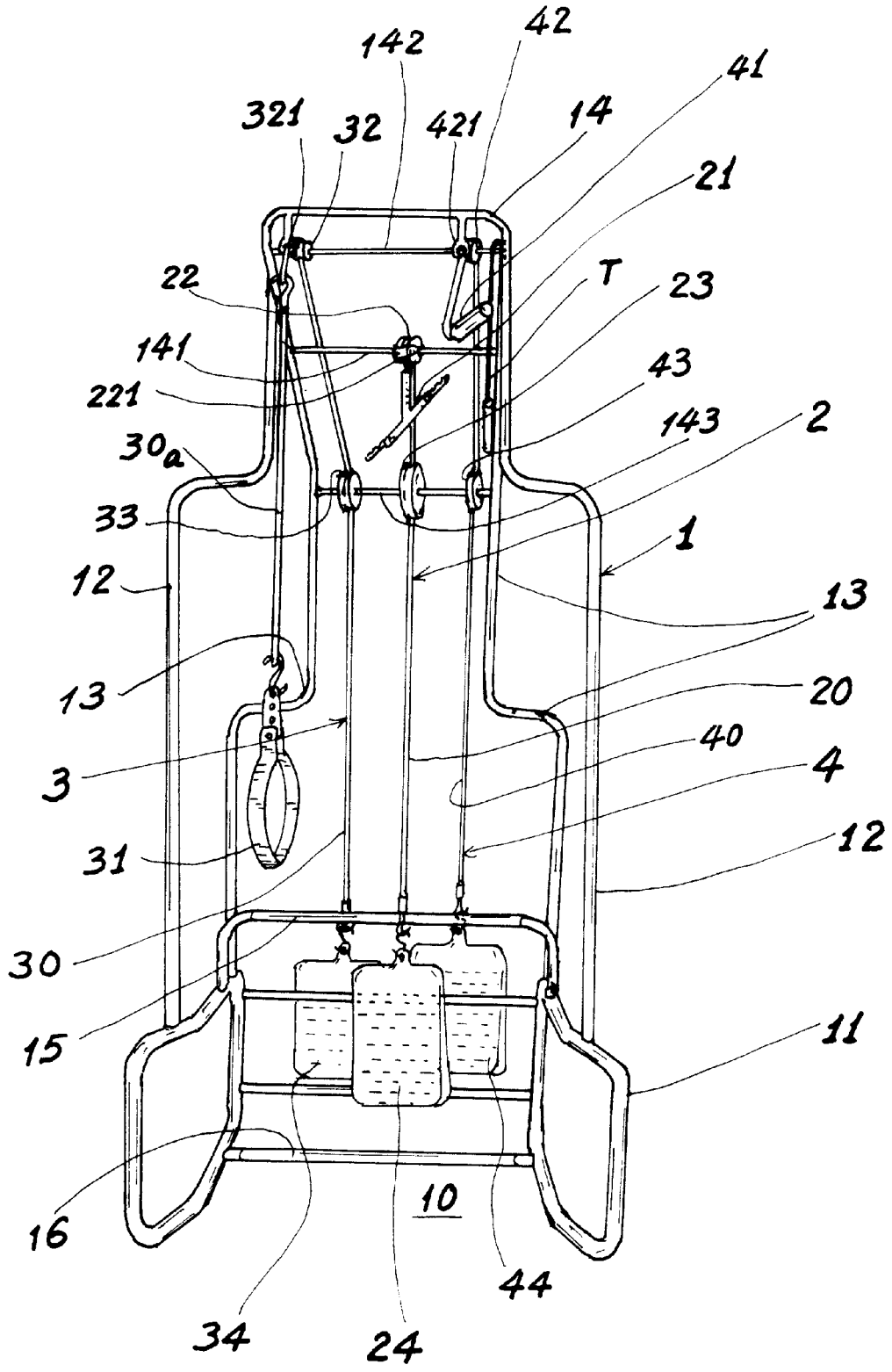
FIG. 1 shows a rehabilitation and gym apparatus in accordance with the present invention.

As shown in FIG. 1, the central hanger 21 is formed as a T-shaped two-hand hanger 21 to be grasped by patient's two hands (not shown) in order to simultaneously rehabilitating his or her two hands (right and left hands).

As shown in FIG. 3, the central beam 141 is adjustably held on a pair of adjusting brackets 25 each juxtapositionally cut with a plurality of recesses 251 in each bracket 25 so that the central beam 141 can be adjustably engaged on any pair of recesses 251 as cut in the pair of adjusting brackets 25 for matching a patient's personal body requirement.

The counter-weight 24 may be formed as a bag filled with water or sand. The counter-weight 24 may be adjusted for its weight by filling the water or sand at a pre-determined volume or weight in the bag.

A stopper 221 is formed beyond the top roller 22 to limit the upward movement of the central hanger 21. For instance,a collar has a small hole formed therethrough provided for passing the central rope 20 through the small hole in the collar, but stopping a handle (or stem) of the central hanger having diameter larger than that of the small hole of the collar.

A tool T having a hook portion formed on an upper end of the tool T is provided for pulling the central hanger 21 downwardly when the patient sits on the chair 5. The tool T may be hanged on the frame 1 ready for use.

The first side exercise means 3 includes: a first side hanger 31 secured to a front end of a first side rope 30, a first front roller 32 rotatably mounted on a front beam 142 transversely secured on a front portion of the roof portion 14 of the frame 1 for primarily winding the first side rope 30 on the first front roller 32, a first rear roller 33 rotatably mounted on a rear beam 143 transversely secured on a rear portion of the roof portion 14 of the frame 1 for secondarily winding the first side rope 30 on the first rear roller 33, and a first side counter-weight 34 secured to a rear bottom end of the first side rope 30; whereby when alternatively actuating the first side hanger 31 downwardly or upwardly as gravitationally balanced by the first side counter-weight 34, a patient's foot or leg can be exercised for foot or leg motion for rehabilitating his or her foot or leg as shown in FIG. 5.

An elastic rope section 30a may be formed on a front portion of the first side rope 30 to increase its flexibility, elasticity of the rope 30 for a soft, flexible and comfortable motion of the patient's leg or foot.

A stopper 321 is formed beyond the roller 32 for stopping the upward movement of the rope section 30*a* of the hanger 31.

The first side hanger 31 is formed as a loop for holding the patient's foot or leg in the loop (Fig. 5).

Figure 6:
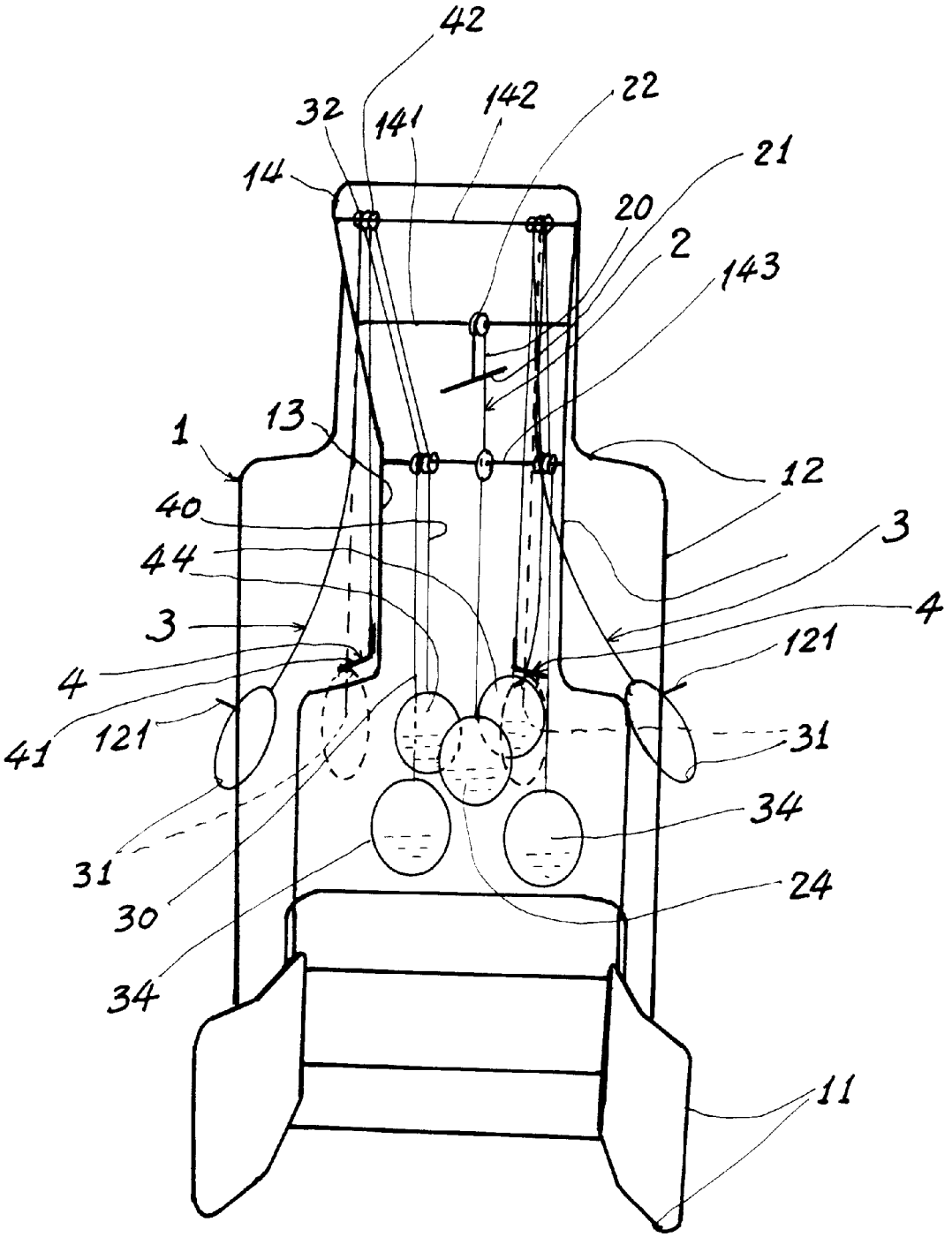
FIG. 6 shows another preferred embodiment of the present invention.

As shown in FIG. 6, a pair of first side exercise means 3 and a pair of second side exercise means 4 are respectively disposed on both right and left sides of the frame 1 for simultaneously rehabilitating the patient's two feet (or two legs) or two hands. When performing the hand motion, each loop 31 of each first side exercise means 3 may be temporarily secured to a side bracket 121 formed on the front column 12 to prevent from obstruction of the hand motion when operating the second side exercise means 4.

The second exercise means 4 includes: a second hanger 41 secured to a front end of a second side rope 40, a second front roller 42 rotatably mounted on a front beam 142 transversely secured on a front portion of the roof portion 14 of the frame 1 for primarily winding the second side rope 40 on the second front roller 42, a second rear roller 43 rotatably mounted on a rear beam 143 transversely secured on a rear portion of the roof portion 14 of the frame 1 for secondarily winding the second side rope 40 on the second rear roller 43, and a second side counter-weight 44 secured to a rear bottom end of the second side rope 40; whereby when alternatively actuating the second side hanger 41 downwardly or upwardly as gravitationally balanced by the second side counter-weight 44, a patient's hand or arm can be exercised for hand or arm motion for rehabilitating his or her hand or arm as shown in FIG. 4. In FIG. 4, a tool T is provided to pull the hanger 41 downwardly to be grasped by the patient's hand before starting the motion.

A stopper 421 is provided for limiting an upward movement of the hanger 41 beyond the roller 42. The hanger 41 may be formed as L shape or any other shapes, not limited in the present invention.

Each hanger 21, 31, 41 may be detachably secured to the rope 20, 30, 40.

An electric driving mechanism (not shown) may be provided in this invention for automatically reciprocating the hanger for physically training the patient's body portions.

A plurality of casters or bottom wheels (not shown) may also be provided on a bottom of the frame 1 for easily moving the apparatus of the present invention. Naturally, a braking device should thus be provided for locking the rehabilitation apparatus at a suitable location in a room or even a hospital or a gym center.

The present invention may be modified without departing from the spirit and scope of the present invention.

I claim:

1. A rehabilitation and gym apparatus for a patient's body motion comprising:

a frame including a base, a pair of front columns and a pair of rear columns formed on the base, and a roof portion formed on a top portion of said columns;

a central exercise means formed on a central portion of said frame for rehabilitating a patient's motion of head or two hands; said central exercise means including: a central hanger secured to a front end of a central rope, a top roller rotatably mounted on a central beam transversely secured on a central portion of the roof portion of the frame for primarily winding the central rope on the top roller, an intermediate roller rotatably mounted on a rear beam transversely secured on a rear portion of the roof portion of the frame for secondarily winding the central rope on the intermediate roller, and a central counter-weight secured to a rear bottom end of the central rope; whereby when alternatively actuating the central hanger downwardly or upwardly as gravitationally balanced by the central counter-weight, a patient's head or both hands can be exercised for head or hand motion for rehabilitating his or her head or hands;

at least a first side exercise means formed on a first side portion of said frame for rehabilitating a patient's motion of foot or leg portion; and at least a second side exercise means formed on a second side portion of said frame for rehabilitating a patient's motion of hand or arm.

2. A rehabilitation and gym apparatus according to claim 1, wherein said central hanger is formed as a head hanger for hanging a patient's head in order for rehabilitating his or her head portion.

3. A rehabilitation and gym apparatus according to claim 1, wherein said central hanger is formed as a T-shaped two-hand hanger to be grasped by patient's two hands in order to simultaneously rehabilitating his or her two hands.

4. A rehabilitation and gym apparatus according to claim 1, wherein said central beam is adjustably held on a pair of adjusting brackets each juxtapositionally cut with a plurality of recesses in each said bracket so that the central beam can be adjustably engaged in any pair of recesses as cut in the pair of adjusting brackets for matching a patient's body.

5. A rehabilitation and gym apparatus according to claim 1, wherein said counter-weight is formed as a bag filled with filler selected from water, sand and heavy matters.

6. A rehabilitation and gym apparatus according to claim 1, wherein said central exercise means includes a stopper formed beyond the top roller to limit an upward movement of the central hanger.

7. A rehabilitation and gym apparatus according to claim 1, wherein said central hanger further includes a tool having a hook portion formed on an upper end of the tool provided for pulling the central hanger downwardly when the patient sits on a chair.

8. A rehabilitation and gym apparatus according to claim 1, wherein said first side exercise means includes: a first side hanger secured to a front end of a first side rope, a first front roller rotatably mounted on a front beam transversely secured on a front portion of the roof portion of the frame for primarily winding the first side rope on the first front roller, a first rear roller rotatably mounted on a rear beam transversely secured on a rear portion of the roof portion of the frame for secondarily winding the first side rope on the first rear roller, and a first side counter-weight secured to a rear bottom end of the first side rope; whereby when alternatively actuating the first side hanger downwardly or upwardly as gravitationally balanced by the first side counter-weight, a patient's foot or leg can be exercised for foot or leg motion for rehabilitating his or her foot or leg.

9. A rehabilitation and gym apparatus according to claim 8, wherein said first side rope includes an elastic rope section formed on a front portion of the first side rope to increase its flexibility and elasticity of the side rope.

10. A rehabilitation and gym apparatus according to claim 1, wherein said second exercise means includes: a second hanger secured to a front end of a second side rope, a second front roller rotatably mounted on a front beam transversely secured on a front portion of the roof portion of the frame for primarily winding the second side rope on the second front roller, a second rear roller rotatably mounted on a rear beam transversely secured on a rear portion of the roof portion of the frame for secondarily winding the second side rope on the second rear roller, and a second side counter-weight secured to a rear bottom end of the second side rope; whereby when alternatively actuating the second side hanger downwardly or upwardly as gravitationally balanced by the second side counter-weight, a patient's hand or arm can be exercised for hand or arm motion for rehabilitating his or her hand or arm.

* * * * *